US006326057B1

(12) United States Patent
Das et al.

(10) Patent No.: US 6,326,057 B1
(45) Date of Patent: Dec. 4, 2001

(54) VAPOR PHASE DIFFUSION ALUMINIDE PROCESS

(75) Inventors: Nripendra N. Das, West Chester; Thomas E. Mantkowski, Madeira; Jackie L. King, Franklin; Floyd A. Swigert, Cincinnati; W. Michael Gmerek, Jr., West Chester, all of OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/474,549

(22) Filed: Dec. 29, 1999

(51) Int. Cl.[7] ..... C23C 16/00; C23C 16/12

(52) U.S. Cl. ..... 427/255.26; 427/140; 427/143; 427/250

(58) Field of Search ..... 427/253, 250, 427/255.26, 142, 140

(56) References Cited

U.S. PATENT DOCUMENTS

| | | | | |
|---|---|---|---|---|
| 3,486,927 | | 12/1969 | Gauje | 427/253 |
| 3,598,638 | * | 8/1971 | Levine | 117/107.2 |
| 3,951,642 | | 4/1976 | Chang et al. | 75/5 R |
| 3,961,910 | * | 6/1976 | Baladjanian et al. | 29/197 |
| 3,993,454 | | 11/1976 | Giggins, Jr. et al. | 428/553 |
| 5,817,371 | | 10/1998 | Gupta et al. | 427/454 |
| 5,897,966 | * | 4/1999 | Grossklaus, Jr. et al. | 428/652 |
| 6,020,075 | | 2/2000 | Gupta et al. | 428/612 |
| 6,146,696 | * | 11/2000 | Das et al. | 427/253 |
| 6,168,874 | | 1/2001 | Gupta et al. | 428/623 |
| 6,174,448 | | 1/2001 | Das et al. | 216/2 |

* cited by examiner

*Primary Examiner*—Shrive P. Beck
*Assistant Examiner*—Jennifer Kolb
(74) *Attorney, Agent, or Firm*—Andrew C. Hess; V. Ramaswamy

(57) ABSTRACT

A process for forming a diffusion aluminide coating on an article, such as a component for a gas turbine engine. The process is a vapor phase process that generally entails placing the article in a coating chamber containing an aluminum donor material, without any halide carrier or inert filler present. The aluminum donor material consists essentially of about 20 to about 70 weight percent aluminum, with the balance being chromium or cobalt. While the article is held out of contact with the donor material, coating is initiated in an inert or reducing atmosphere by heating the article and the donor material to vaporize the aluminum constituent of the donor material, which then condenses on the surface of the article and diffuses into the surface to form a diffusion aluminide coating on the article.

16 Claims, 1 Drawing Sheet

VAPOR PHASE DIFFUSION ALUMINIDE PROCESS

FIELD OF THE INVENTION

The present invention relates to processes for forming protective diffusion coatings. More particularly, this invention relates to a process of forming a diffusion aluminide coating by vapor phase deposition without the use of a carrier gas.

BACKGROUND OF THE INVENTION

The operating environment within a gas turbine engine is both thermally and chemically hostile. Significant advances in high temperature capabilities have been achieved through the development of iron, nickel and cobalt-base superalloys and the use of oxidation-resistant environmental coatings capable of protecting superalloys from oxidation, hot corrosion, etc.

Diffusion aluminide coatings have particularly found widespread use for superalloy components of gas turbine engines. These coatings are generally formed by such methods as diffusing aluminum deposited by chemical vapor deposition (CVD) or slurry coating, or by a diffusion process such as pack cementation, above-pack, or vapor (gas) phase deposition. Diffusion aluminide coatings generally have two distinct zones, the outermost of which is an additive layer containing an environmentally-resistant intermetallic represented by MAl, where M is iron, nickel or cobalt, depending on the substrate material. The MAl intermetallic is the result of deposited aluminum and an outward diffusion of iron, nickel or cobalt from the substrate. Beneath the additive layer is a diffusion zone comprising various intermetallic and metastable phases that form during the coating reaction as a result of diffusional gradients and changes in elemental solubility in the local region of the substrate. During high temperature exposure in air, the additive layer forms a protective aluminum oxide (alumina) scale or layer that inhibits oxidation of the diffusion coating and the underlying substrate.

Components located in certain sections of gas turbine engines, such as the turbine, combustor and augmentor, are often thermally insulated with a ceramic layer in order to reduce their service temperatures, which allows the engine to operate more efficiently at higher temperatures. These coatings, often referred to as thermal barrier coatings (TBC), must have low thermal conductivity, strongly adhere to the article, and remain adherent throughout many heating and cooling cycles. Coating systems capable of satisfying these requirements typically include a metallic bond coat that adheres the thermal-insulating ceramic layer to the component. In addition to their use as environmental coatings, diffusion aluminide coatings have found wide use as bond coats for TBCs.

Diffusion aluminizing processes generally entail reacting the surface of a component with an aluminum-containing gas composition. In pack cementation processes, the aluminum-containing gas is produced by heating a powder mixture of an aluminum-containing source (donor) material, a carrier (activator) such as an ammonium or alkali metal halide, and an inert filler such as calcined alumina. The ingredients of the powder mixture are mixed and then packed and pressed around the component to be treated, after which the component and powder mixture are heated to a temperature sufficient to vaporize and react the activator with the source material to form a volatile aluminum halide, which then reacts at the surface of the component to form the diffusion aluminide coating.

In contrast to pack processes, vapor phase aluminizing (VPA) processes are able to form a diffusion aluminide coating without the use of an inert filler. In addition, the source material can be an aluminum alloy or an aluminum halide. If the source material is an aluminum halide, a separate activator is not required. Also contrary to pack processes, the source material is placed out of contact with the surface to be aluminized. Similar to pack processes, vapor phase aluminizing is performed at a temperature at which the activator or aluminum halide will vaporize, forming an aluminum halide vapor that reacts at the surface of the component to form the diffusion aluminide coating. VPA processes avoid significant disadvantages of pack processes, such as the use of an inert filler that must be discarded, the use of a source material that is limited to a single use, and the tendency for pack powders to obstruct cooling holes in air-cooled components.

As apparent from the above, pack cementation and vapor phase processes have conventionally required the use of halide carriers or activators. A resulting limitation of these processes is that halides are known to deteriorate any ceramic TBC present on the article being aluminized. Consequently, pack and vapor phase processes have not been widely employed to refurbish components that have existing TBC and require aluminizing of a limited region of the component, such as where TBC has spalled or the interior cooling channels of an air-cooled component. An exception has been a pack cementation process taught by U.S. Pat. No. 5,254,413 to Maricocchi, which employs a source material of about 18 to 45 weight percent aluminum with the balance inert filler. While avoiding the undesirable effect that a halide carrier has on a ceramic TBC, Maricocchi's pack cementation process shares the same disadvantages as those noted for pack cementation processes, namely, the need for an inert filler, the obstruction of cooling holes, and the use of an aluminum powder that must be either discarded or reprocessed after a single use.

BRIEF SUMMARY OF THE INVENTION

The present invention generally provides a process for forming a diffusion aluminide coating on an article, such as a component for a gas turbine engine. The process is a vapor phase process that generally entails placing the article in a coating chamber containing an aluminum donor material, without any halide carrier or inert filler present. According to this invention, the aluminum donor material consists essentially of about 20 to about 70 weight percent aluminum, with the balance being chromium, cobalt or another higher melting alloying agent. In accordance with vapor phase processing, the article remains out of contact with the donor material during the coating process. In an inert or reducing atmosphere, coating is initiated by heating the article and the donor material to vaporize the aluminum constituent of the donor material, which then condenses on the surface of the article and diffuses into the surface to form a diffusion aluminide coating on the article. The donor material can be reused a number of times before requiring any reprocessing to expose additional aluminum at the donor material surface.

In view of the above, the process of this invention is able to produce a diffusion aluminide coating without the use of a carrier or activator. As a result, the process can be employed to repair or refurbish a bond coat exposed by a spalled region of ceramic TBC without deteriorating the remaining TBC. In addition, the process of this invention is able to produce a diffusion aluminide coating without the disadvantages associated with pack cementation processes, such as the production of large quantities of waste byproduct as a result of pack powders being limited to a single use.

Other objects and advantages of this invention will be better appreciated from the following detailed description.

DETAILED DESCRIPTION OF THE INVENTION

Figure 1:
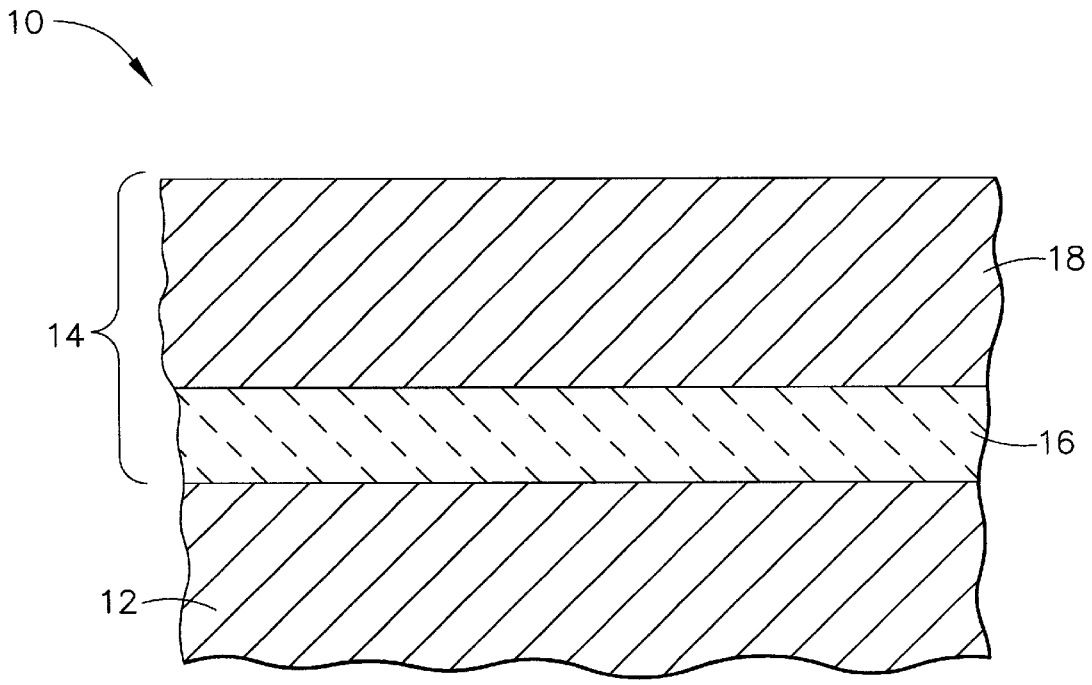
FIG. 1 represents a partial cross-sectional view of TBC adhered to a substrate by a diffusion aluminide coating produced in accordance with this invention.

The present invention is generally applicable to components that operate within thermally and chemically hostile environments, and are therefore subjected to oxidation and hot corrosion. Notable examples of such components include the high and low pressure turbine nozzles, blades and shrouds of gas turbine engines. While the advantages of this invention will be described with reference to gas turbine engine hardware, the teachings of the invention are generally applicable to any component on which an aluminide coating may be used to protect the component from its hostile operating environment.

FIG. 1 represents a partial cross section of a gas turbine engine component 10, such as a turbine blade, whose substrate 12 is protected by thermal barrier coating (TBC) system 14. The TBC system 14 is shown as including a ceramic TBC 18 and a diffusion aluminide coating 16 produced by the method of this invention. Typical materials for the substrate 12 (and therefore the component) include nickel, iron and cobalt-base superalloys, though other alloys could be used. The aluminide coating 16 serves as a bond coat for the ceramic TBC 18. When sufficiently heated in an oxidizing atmosphere, the coating 16 develops an alumina ($Al_2O_3$) layer or scale (not shown) on its surface. The alumina scale protects the underlying superalloy substrate 12 from oxidation and provides a surface to which the TBC 18 more tenaciously adheres. The TBC 18 can be deposited by air plasma spraying (APS), low pressure plasma spraying (LPPS) or a physical vapor deposition technique, e.g., electron beam physical vapor deposition (EBPVD), which yields a strain-tolerant columnar grain structure (not shown). A preferred material for the TBC 18 is zirconia partially stabilized with yttria (yttria-stabilized zirconia, or YSZ), though zirconia fully stabilized with yttria could be used, as well as zirconia stabilized by other oxides, such as magnesia (MgO), calcia (CaO), ceria ($CeO_2$) or scandia ($Sc_2O_3$).

As known in the art, the diffusion coating 16 contains oxidation-resistant MAl intermetallic phases, such as the nickel-aluminide beta phase (NiAl), as well as other intermetallic phases, depending on whether other metals were deposited or otherwise present in or on the surface of the substrate 12 prior to aluminizing. For example, the diffusion coating 16 may include $PtAl_2$ or platinum in solution in the MAl phase if platinum was plated on the substrate 12 prior to forming the aluminide coating 16. A suitable thickness for the diffusion aluminide coating 16 is typically about 25 to 125 micrometers (about 0.001–0.005 inch).

According to this invention, the aluminide coating 16 is formed by a vapor phase process by which aluminum is deposited on the substrate 12 and then diffuses into the substrate 12 to form aluminide intermetallics. While similar to prior art vapor phase processes, and therefore sharing certain advantages associated with vapor phase deposition, the method of this invention does not require a halide carrier or activator to transfer the aluminum to the substrate 12. Instead, coating is performed in an inert or reducing atmosphere (such as argon or hydrogen, respectively) within a coating chamber (retort) that contains only the component to be coated and an aluminum source (donor) material. Accordingly, the coating process relies entirely on the aluminum of the donor material vaporizing, condensing on the surface of the substrate 12, and then diffusing into the substrate 12 to form the diffusion aluminide coating 16.

In a preferred embodiment of the invention, the donor material consists essentially of about 20 to about 70 weight percent aluminum, with the balance being chromium, cobalt or another higher melting alloying agent. A particularly suitable composition for the donor material is a chromium-aluminum alloy consisting essentially of 25 to 35 weigh percent aluminum, with the balance being chromium. The donor material can be used in various forms, with pellets or chunks having diameters of about 0.1 mm to about 4 mm being particularly suitable.

Conventional coating conditions can otherwise be used and maintained in the chamber, including the use of coating temperatures of at least 980 degrees Centigrade (about 1800 degrees Fahrenheit) and coating durations of at least two hours. A preferred minimum treatment is a coating temperature of between about 1050 degrees Centigrade and about 1080 degrees Centigrade (about 1925 degrees Fahrenheit to about 1975 degrees Fahrenheit maintained for a duration of two to six hours. Using the above coating conditions, the vapor phase process of this invention has been shown to successfully coat both exterior and interior surfaces (e.g., cooling passages) of an air-cooled gas turbine engine component.

During an investigation leading to this invention, diffusion aluminide coatings were deposited on nickel and cobalt-base superalloy specimens using pellets of a chromium-aluminum alloy or a cobalt-aluminum alloy, respectively, as the sole donor material. The aluminum of the CrAl alloy constituted about 25 to 35 weight percent of the donor mass, and the aluminum of the CoAl alloy constituted about 45 to 55 weight percent of the donor mass. In accordance with this invention, neither a halide activator or inert filler was used or present in the coating chamber. While the specimens were supported out of contact with the donor material, vapor phase deposition was performed at temperatures of about 1050 degrees Centigrade (about 1925 degrees Fahrenheit) and about 1080 degrees Centigrade (about 1975 degrees Fahrenheit). Coating durations of between two and six hours were employed to yield diffusion aluminide coatings having thicknesses of about 0.0018 inch (about 46 micrometers). From this investigation, it was concluded that coating thicknesses of about 0.001 to 0.003 inch (about 25 to about 76 micrometers) could be reliably and repeatably produced using appropriate coating times.

While the invention has been described in terms of a preferred embodiment, it is apparent that other forms could be adopted by one skilled in the art. Accordingly, the scope of the invention is to be limited only by the following claims.

What is claimed is:

1. A process for forming a diffusion aluminide coating, the process comprising the steps of:

placing an article in a coating chamber containing a donor material consisting essentially of about 20 to about 70 weight percent aluminum with the balance being an alloying agent with a higher melting point than aluminum, the article not contacting the donor material, the coating chamber not containing any carrier material or inert filler material; and then in an inert or reducing atmosphere, heating the article and the donor material to vaporize the aluminum of the donor material, which then contacts the surface of the article to form a diffusion aluminide coating on the surface.

2. A process according to claim 1, wherein the donor material consists of a single metallic alloy consisting essentially of about 25 to about 35 weight percent aluminum, with the balance chromium as the alloying agent.

3. A process according to claim 1, wherein the donor material is in the form of pellets or chunks having diameters of about 0.1 mm to about 4 mm.

4. A process according to claim 1, wherein the article and the donor material are heated to at least 980 degrees Centigrade for a duration of at least two hours.

5. A process according to claim 1, wherein the article and the donor material are heated to about 1050 degrees Centigrade to about 1080 degrees Centigrade for a duration of about two to six hours.

6. A process according to claim 1, wherein the article is formed of a superalloy.

7. A process according to claim 1, wherein the article is a gas turbine engine component.

8. A process according to claim 1, wherein the article has a ceramic coating on the surface thereof, and the process is employed to repair a portion of a bond coat exposed by an opening in the ceramic coating without deteriorating the ceramic coating.

9. A process for forming a diffusion aluminide coating on a superalloy component of a gas turbine engine, the process comprising the steps of:

placing the superalloy component in a coating chamber containing a donor material that consists essentially of about 25 to about 35 weight percent aluminum with the balance being chromium, the component not contacting the donor material, the coating chamber not containing any carrier material or inert filler material; and then in an inert or reducing atmosphere, heating the article and the donor material to about 1050 degrees Centigrade to about 1080 degrees Centigrade for a duration of about two to six hours, so that the aluminum of the donor material vaporizes, producing an aluminum vapor that condenses on the surface of the component and diffuses into the surface to form a diffusion aluminide coating on the component.

10. A process according to claim 9, wherein the donor material consists of a single CrAl alloy.

11. A process according to claim 9, wherein the donor material is in the form of pellets or chunks having diameters of about 0.1 mm to about 4 mm.

12. A process according to claim 9, wherein the component has a ceramic coating on the surface thereof, and the process is employed to repair a portion of a bond coat exposed by an opening in the ceramic coating without deteriorating the ceramic coating.

13. A process for forming a diffusion aluminide coating on a superalloy component of a gas turbine engine, the process comprising the steps of:

placing the superalloy component in a coating chamber containing a donor material that consists essentially of about 45 to about 55 weight percent aluminum with the balance being cobalt, the component not contacting the donor material, the coating chamber not containing any carrier material or inert filler material; and then in an inert or reducing atmosphere, heating the article and the donor material to about 1050 degrees Centigrade to about 1080 degrees Centigrade for a duration of about two to six hours, so that the aluminum of the donor material vaporizes, producing an aluminum vapor that condenses on the surface of the component and diffuses into the surface to form a diffusion aluminide coating on the component.

14. A process according to claim 13, wherein the donor material consists of a single CoAl alloy.

15. A process according to claim 13, wherein the donor material is in the form of pellets or chunks having diameters of about 0.1 mm to about 4 mm.

16. A process according to claim 13, wherein the component has a ceramic coating on the surface thereof, and the process is employed to repair a portion of a bond coat exposed by an opening in the ceramic coating without deteriorating the ceramic coating.

* * * * *